US006126255A

United States Patent [19]

Yang

[11] Patent Number: 6,126,255

[45] Date of Patent: Oct. 3, 2000

[54] RETAINING DEVICE FOR A DETACHABLE DRAWER TRACK

[76] Inventor: Jun-Long Yang, No. 33, Da-Hsin 15th St., Tai-Ping City, Taichung Hsien, Taiwan

[21] Appl. No.: 09/518,106

[22] Filed: Mar. 3, 2000

[51] Int. Cl.[7] ..... A47B 88/16

[52] U.S. Cl. ..... 312/334.46; 312/334.44

[58] Field of Search ..... 312/334.46, 334.47, 312/334.44, 333, 334.1, 330.1; 384/18, 21, 22

[56] References Cited

U.S. PATENT DOCUMENTS

| | | | |
|---|---|---|---|
| 4,932,792 | 6/1990 | Baxter | 312/334.46 X |
| 5,181,782 | 1/1993 | Wojcik | 312/334.44 X |
| 5,466,060 | 11/1995 | Hoffman | 312/334.44 X |
| 5,722,750 | 3/1998 | Chu | 312/334.46 X |
| 5,951,132 | 9/1999 | Cirocco | 312/334.46 |

*Primary Examiner*—Peter M. Cuomo
*Assistant Examiner*—James O. Hansen
*Attorney, Agent, or Firm*—William E. Pelton, Esq.

[57] ABSTRACT

A retaining device for a detachable drawer track including a track having a limit block attached to one end and a limit device attached to the other end. The limit device has two blocks extending therefrom and a bumper formed between the two blocks. A rail is slidably mounted on the track by a bearing. A retaining device is attached to the rail. The retaining device includes a retaining plate attached to the rail and a pull bar connected to the retaining plate. The retaining plate is Y-shaped and has two levers projecting toward the limit device and a hole defined at the apex of the levers. Each of the levers has a recess defined to receive the corresponding one of the blocks and an activation groove defined in the bottom thereof and being parallel thereto. The activation grooves communicate with the hole, and the pull bar is slidably mounted between the retaining plate and the rail. A shank extends from the pull bar toward the retaining plate. The shank includes a free end having two bosses extending up therefrom and received in the hole of the retaining plate. The distance between the two bosses is close to the minimum distance of the two activation grooves, and the bosses move in the corresponding activation grooves.

5 Claims, 6 Drawing Sheets

RETAINING DEVICE FOR A DETACHABLE DRAWER TRACK

BACKGROUND OF THE INVENTION

1. Field of the Invention

The present invention relates to a retaining device, and more particularly to a retaining device for a detachable drawer track.

2. Description of Related Art

A conventional retaining device for a drawer track in accordance with the prior shown in FIGS. 6 and 7 comprises a track (60), a rail (70) slidably mounted in the track (60) and a retaining plate (90) attached to the rail (70). The conventional track further comprises a bearing (80) mounted between the track (60) and the rail (70) to make the rail (70) slide more easily in the track (60).

The track (60) is U-shaped and has two sidewalls (61) with a guide (63) defined in each sidewall (61). The two guides (63) are formed on opposite sides of each sidewall (61). A limit notch (66) is formed on one end of the track (60) and a limit plate (64) extend perpendicular to the track (60) from the other end. The track (60) has multiple holes (65) defined in the bottom to allow the track (60) to be attached to a piece of furniture (not shown) by a screw (not shown) or a rivet (not shown).

The rail (70) is U-shaped and has two wings (72) with a sliding groove (74) defined in each wing (72). The sliding grooves (74) correspond to and align with the guides (63) in the track (60). The rail (70) has multiple holes (76) defined in the bottom to allow the rail (70) to be attached to a drawer (not shown).

The bearing (80) is U-shaped and has two sets of races (82) each received between the guide (63) in the track (60) and the sliding groove (74) in the rail (70). Multiple cavities (84) are defined in each of the races (82) to hold ball bearings (85) and allow the rail (70) to slide more easily in the track (60).

The retaining plate (90) is flexible. The first end (91) of the retaining plate (90) nearest to the limit plate (64) is attached to the track (60), and a lever (93) is formed on the second end (92). A square hole (94) is defined in the lever (93) to receive the limit notch (66) and lock the rail (70) with the track (70) in a fixed position. The lever (93) must be pressed to release the square hole (94) from the limit notch (66) so the drawer with rail (70) can be pushed back or be drawn out completely and removed.

The conventional retaining device for a detachable drawer track keeps a drawer from inadvertently sliding completely out, yet allows the drawer to be removed when desired. However, it still has several disadvantages.

1. It presents a safety hazard. Whatever a user wants to push the drawer back or detach the drawer, he must press the lever (93) of the retaining plate (90). However, the retaining plate (90) always is a thin metal plate and formed by molding press so the edge thereof is very rough and sharpe like a knife. Consequently, if a user is careless when pressing the retaining plate (90), his fingers are easily injured.

2. It is not very convenient. The conventional retaining device track (60) only has a limit notch (66) formed on one end. Consequently, the drawer often rebounds and extends again for some reason after being pushed in. It is not very convenient and sometimes a user may bump or hit the extended drawer.

The present invention has arisen to mitigate and/or obviate the disadvantages of the conventional retaining device for a detachable drawer track.

SUMMARY OF THE INVENTION

In accordance with one aspect of the present invention, an improved retaining device is provided. The retaining device of the present invention is for a detachable drawer. The retaining device is made of resilient material such as plastic. The retaining device for a drawer track in accordance with the present invention includes a track, a rail, a bearing and a retaining device. The track, the rail and the bearing are similar to the conventional devices used with a drawer. However, a limit block is attached to one end of the track, and a limit device is attached to the other end. The limit block prevents the rail from extending again after being closed unless it is pulled.

The retaining device includes a retaining plate attached to the rail and a pull bar movably mounted on the rail and connected to the retaining plate. The retaining plate engages and holds the limit device when the rail is pulled out. To push the rail back a user does not need to press any parts. He only needs to push the rail directly and the retaining plate will release from the limit device. Then the rail moves back and is held in place by the limit block. If a user pulls the pull bar after the retaining plate engages the limit device, the retaining plate will release the limit device and the drawer can be detached.

Further benefits and advantages of the present invention will become apparent after a careful reading of the detailed description with appropriate reference to the accompanying drawings.

DETAILED DESCRIPTION OF THE INVENTION

Figure 1:
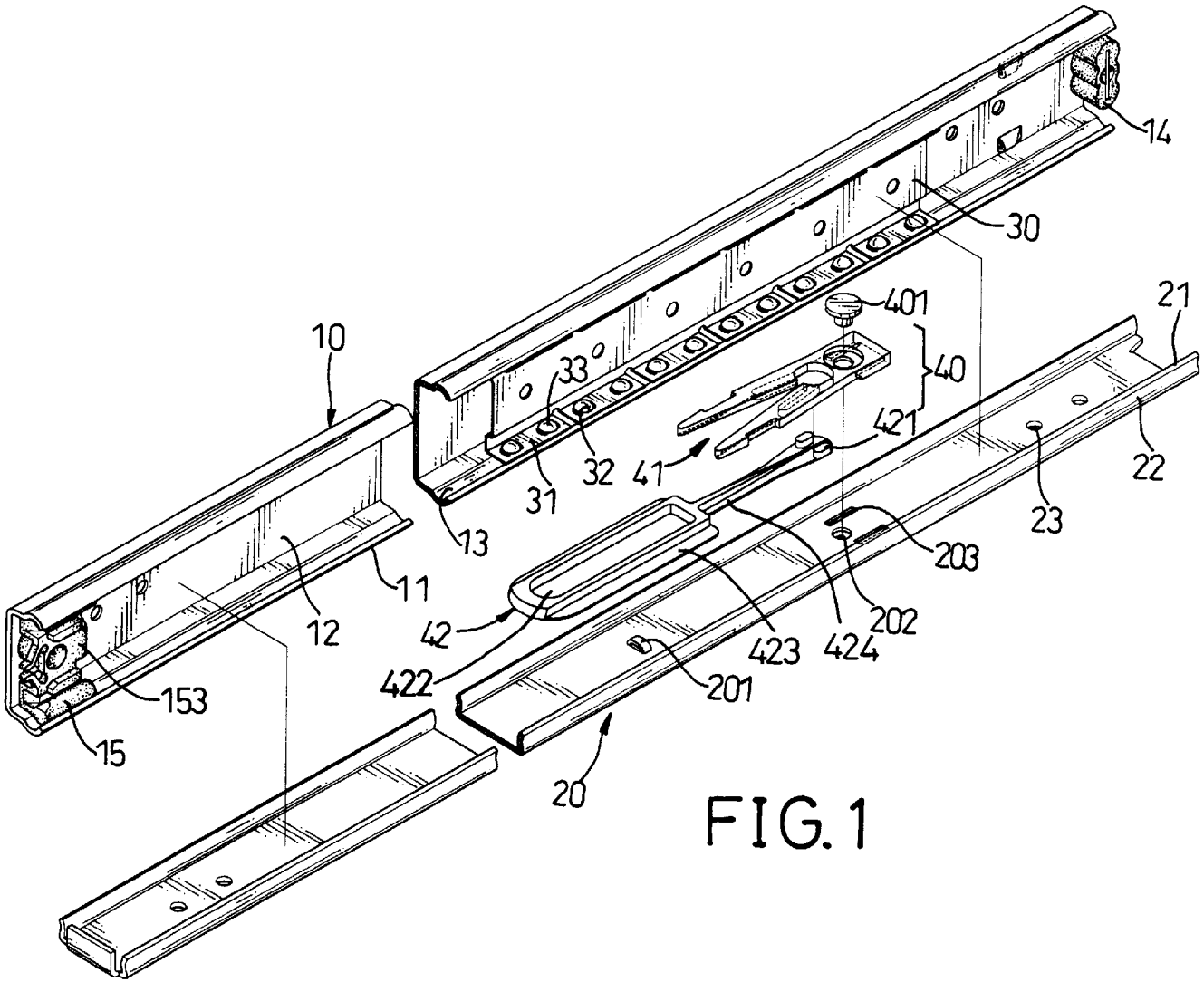
FIG. 1 is a partially exploded perspective view of a retaining device for a detachable drawer track in accordance with the present invention.
Figure 2:
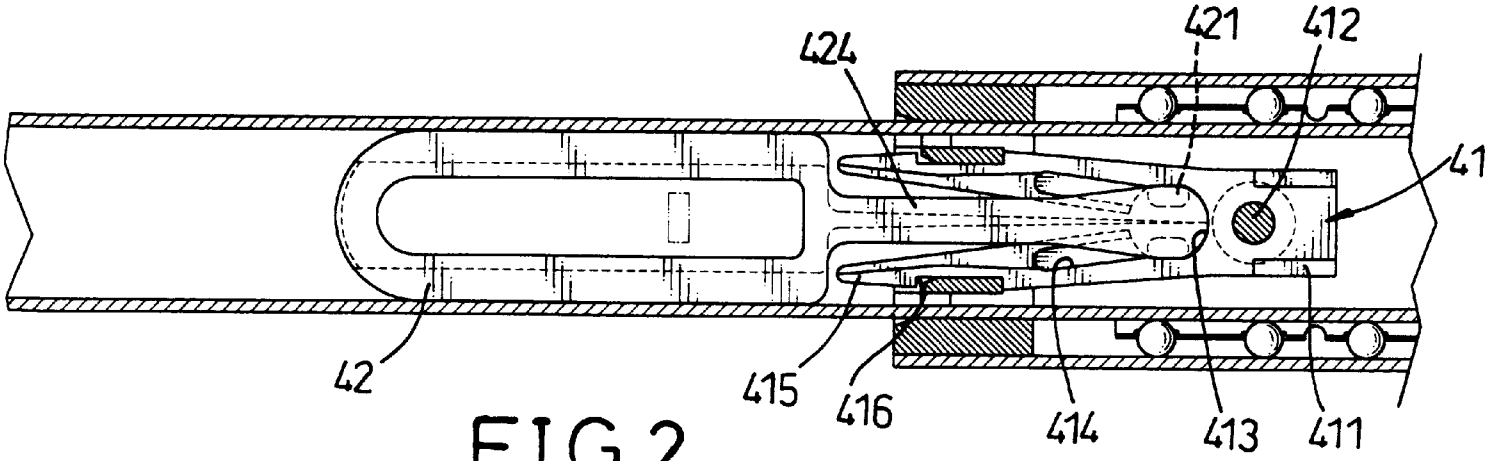
FIG. 2 is a top plan view in partial section of the retaining device in FIG. 1 when retaining.
Figure 3:
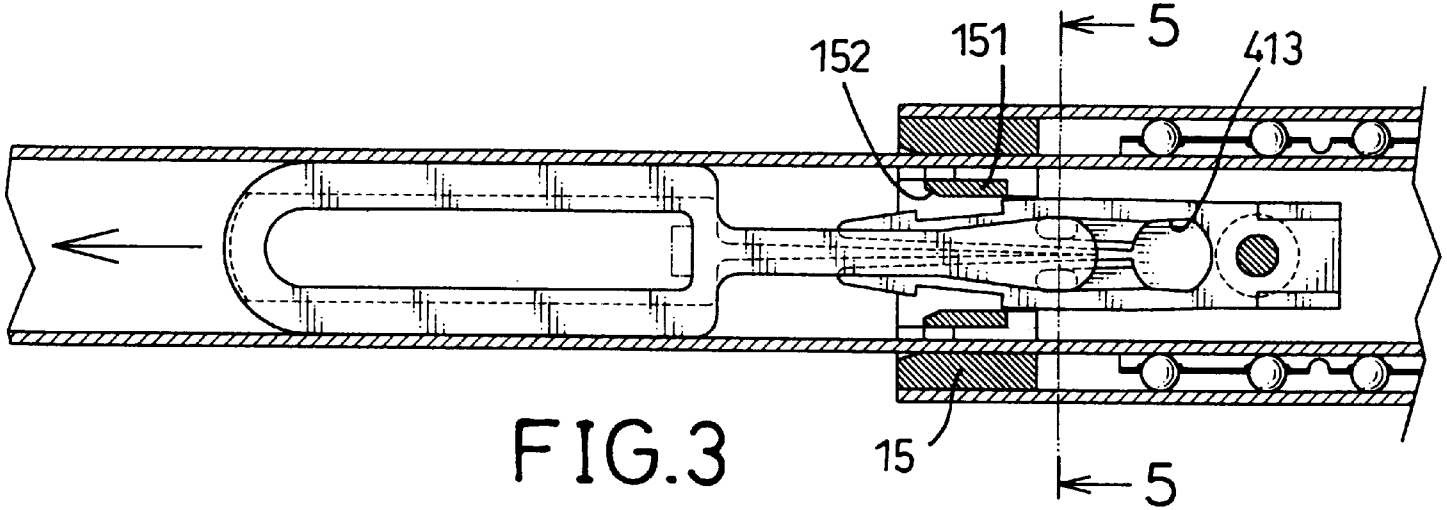
FIG. 3 is a is a top plan view in partial section of the retaining device in FIG. 1 when a pull bar being pulled.

Referring to the drawings and initially to FIGS. 1–3, a retaining device for a detachable drawer track in accordance with the present invention comprises a track (10), a rail (20) slidably mounted inn the track (10) and a retaining device (40) attached to the rail (20). The track further comprises a bearing (30) mounted between the track (10) and the rail (20) to make the rail (20) slide more easily on the track (10).

The track (10) is U-shaped and has two sidewalls (11) with a guide (13) defined in each sidewall (11). The two guides (13) correspond with and face each other and form a slide space (12) between the guides (13. A limit block (14) is attached to the first end of the track (60), and a limit device (15) is attached to the other end. The limit block (14) is made of resilient material. The limit device (15) has a rectangular block (151) extending from each side and parallel to the guide (13). The end of each block (151) opposite to the limit block (14) forms a guiding portion (152). The guiding portions (152) face each other. The limit device (15) has a bumper (153) formed between the two blocks (151). The bumper (153) has a inclined portion facing the bearing (30). The track (10) has multiple holes (not numbered) defined in the bottom to allow the track (10) to be attached to a piece of furniture (not shown) by a screw (not shown), a rivet (not shown) or the like.

The rail (20) is U-shaped and has two wings (21) a sliding groove (22) defined in each wing (21). These two sliding grooves (22) correspond to and align with of the guides (13) in the track (10). A lug (201) is formed near the center of the rail (20) and protrudes toward the track (10). Two slots (203) and an opening (202) are defined in the bottom of the rail (20) with the opening (202) between the two slots (203). The rail (20) has multiple through holes (23) defined in the bottom to attach the rail (20) to a drawer (not shown) of a piece of furniture by a screw (not shown) a rivet (not shown) or the like.

The retaining device (40) includes a retaining plate (41) attached to the rail (20) and a pull bar (42) connected to the retaining plate (41). The retaining plate (41) includes two extensions (411) that mate with the slots (203) in the rail (20). A rivet hole (412) is defined in the retaining plate (41) corresponding to the opening (202) in the rail (20). A rivet (401) penetrates the rivet hole (412) and the opening (202) to attach the retaining plate (41) to the rail (20). The retaining plate (41) is Y-shaped and has two levers (415) extending toward the limit device (15) with a hole (413) defined at the apex of the two levers (415). Each of the levers (415) has a recess (416) defined to receive one of the corresponding blocks (151) when the rail is fully extended and an activation groove (414) defined in the bottom and aligned with the levers (415). The activation grooves (414) communicate with the hole (413).

The pull bar (42) is slidably mounted between the retaining plate (41) and the rail (20) includes two having a wing (423) extending out from each side of the pull bar (42) to fit in of the gap between the rail (20) and the sliding groove (22) to prevent the pull bar (42) detaching from the rail (20). The pull bar (42) contains a central opening (422) to receive the lug (201) and prevent the pull bar (42) from being pulled over the lug (201). A shank (424) extends from the pull bar (42) toward the retaining plate (41). Two bosses (421) are formed on and extend up from the free end of the shank (424) and are received in the hole (413) in the retaining plate (41). The distance between the two bosses (421) is close to the minimum distance of the two activation grooves (414). The bosses (421) are moved into the corresponding activation groove (414) when the pull bar (42) is pulled.

The bearing (30) is U-shaped and has two races (31) each received between the guide (13) of the track (10) and the sliding groove (22) of the rail (20). Each of the races (31) has multiple cavities (32) defined therein to received a ball bearing (33) and make the rail (20) slide more easily in the track (10).

Referring to the FIGS. 1, 2 and 3, the limit block (14) on the track (10) is wilder than of the separation between the two sliding grooves (22) on the rail (20). Therefore the rail (20) is held in place by the limit block (14) when the rail (20) is pushed in. The block (151) of the limit device (15) is received in the recess (416) of the lever (415) to hold the rail (20) in place temporarily when the retaining plate (41) is pulled to the limit device (15).

Figure 4:
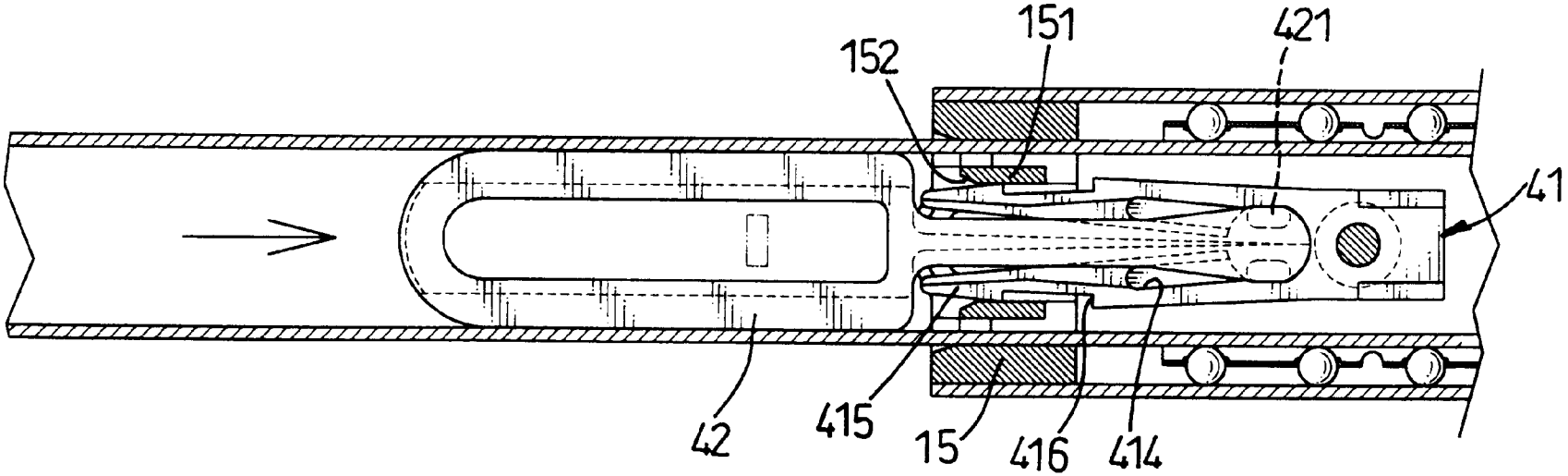
FIG. 4 is a is a top plan view in partial section of the retaining device in FIG. 1 when a rail being pushed.

Referring to FIG. 4, the lever (415) of the retaining plate (41) is pressed by the block (151) along the edge of the guiding portion (152) and is released when the rail (20) is pushed. Consequently, the rail (20) can be moved back and held in place by the limit block (14).

Figure 5:
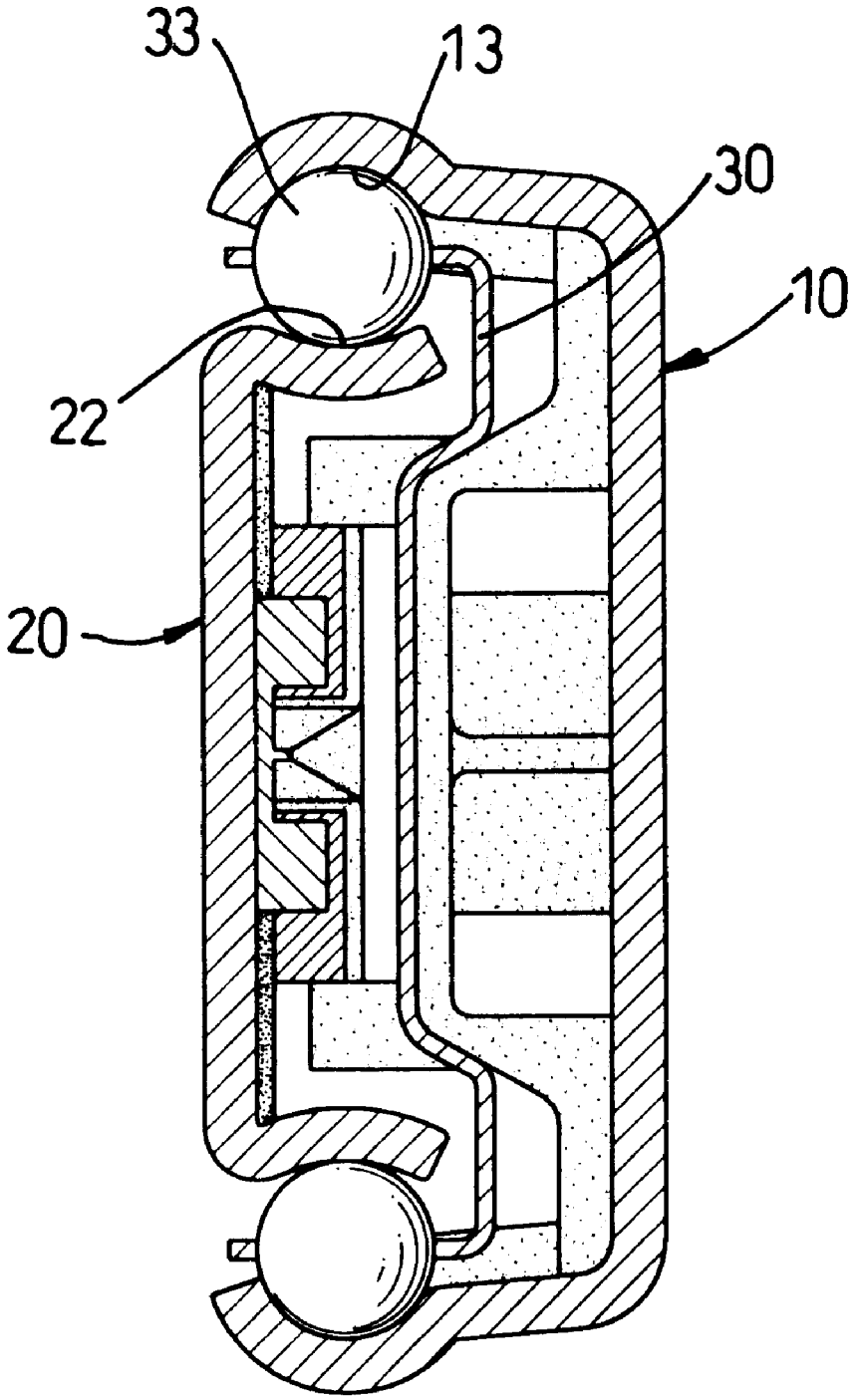
FIG. 5 is a cross sectional end view of the retaining device along the line 5—5 in FIG. 3.
Figure 6:
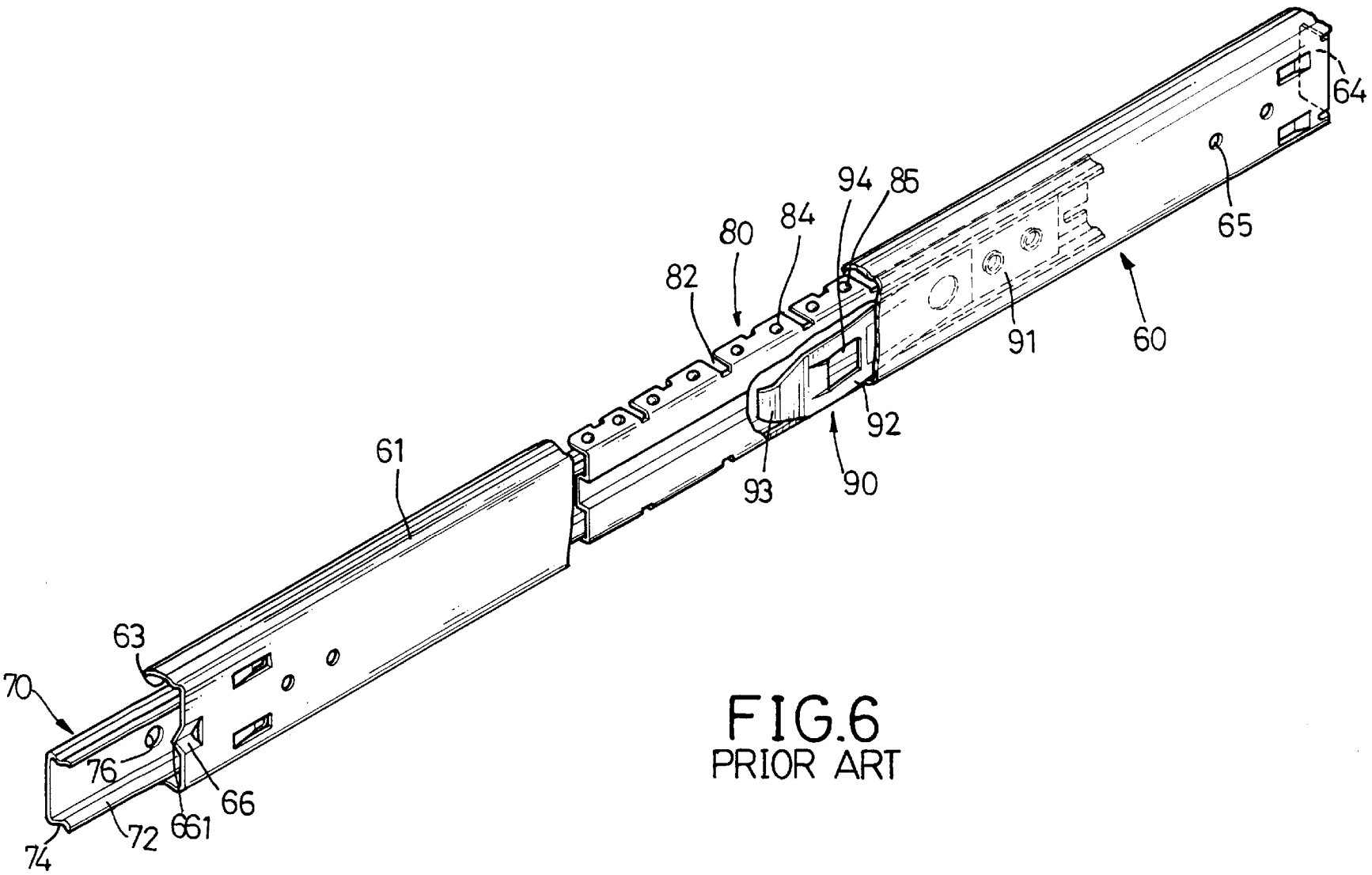
FIG.6 PRIOR ART
FIG. 6 is a perspective view in partial section of a conventional retaining device for a detachable drawer track in accordance with the prior art.
Figure 7:
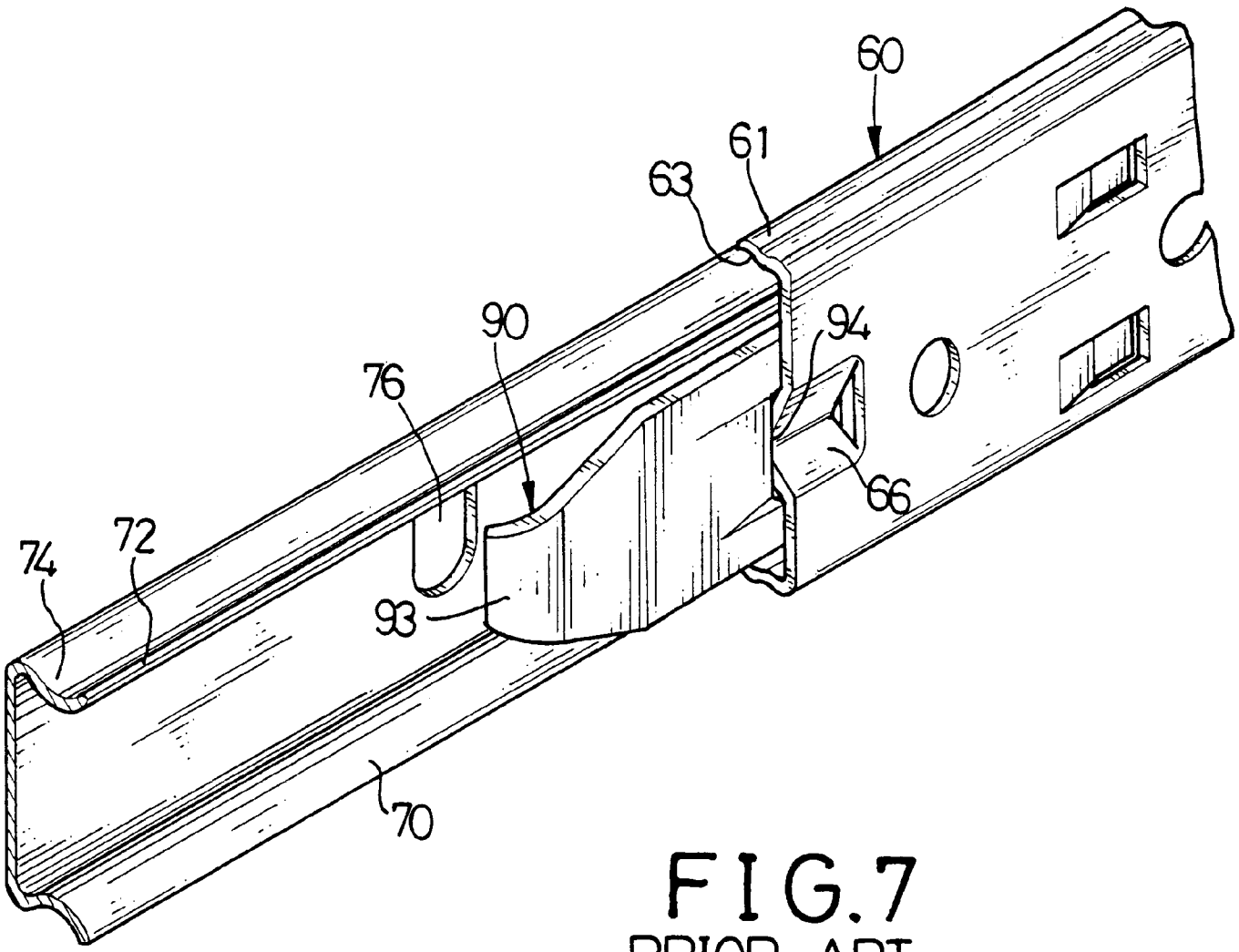
FIG.7 PRIOR ART
FIG. 7 is a partial perspective view in partial section of the conventional retaining device in FIG. 6 when retaining.

Referring to FIGS. 3, 4 and 5, pulling the pull bar (42) will move the bosses (421) into the activation grooves (414) and squeeze the two levers (415) toward each other. As the levers (415) move toward each other, the recesses (416) in the levers (415) release the blocks (151) in the limit device (15) so the rail (20) can detach from the track (10). The bearing (30) abuts the inclined portion of the bumper (153) of the limit device (15). The inclined portion of the bumper (153) is inserted in to the gap between the track (10) and the bearing (30) to hold the bearing in place after the rail (20) detaches from the track (10).

The retaining device for a detachable drawer track in accordance with the present invention is safe and convenient. All the parts of the retaining device are injection molded. Injury to a user's fingers is impossible. The track (10) has a limit block (14) attached to one end to hold the rail (20) in place. It is a convenient design to use.

Although the invention has been explained in relation to its preferred embodiment, it is to be understood that many other possible modifications and variations can be made without departing from the spirit and scope of the invention as hereinafter claimed.

What is claimed is:

1. A retaining device for a detachable drawer track comprising:

a track having a limit block attached to one end and a limit device attached to the other end, said limit device having two blocks extending therefrom and a bumper formed between said two blocks;

a rail slidably mounted in said track by a bearing;

a retaining device attached to said rail, said retaining device including a retaining plate attached to said rail and a pull bar connected to said retaining plate, said retaining plate being Y-shaped and having two levers extending toward said limit device and a hole at the apex of the levers, each of said levers having a recess defined to receive the corresponding one of said blocks and an activation groove defined in the bottom thereof and being parallel thereto, said activation grooves communicating with said hole, said pull bar slidably mounted between said retaining plate and said rail; and a shank extending from said pull bar extending toward said retaining plate, said shank having a free end having two bosses extending up therefrom and received in said hole of said retaining plate, the distance between said two bosses being close to the minimum distance between said two activation grooves, said bosses move in the corresponding activation grooves.

2. The retaining device for a detachable drawer track as claimed in claim 1, wherein said rail is U-shaped including two wings each having a sliding groove defined therein.

3. The retaining device for a detachable drawer track as claimed in claim 2, wherein said pull bar includes two sides each having a wing extending out therefrom received in of the gap between the rail and the sliding groove to prevent the pull bar detaching from the rail.

4. The retaining device for a detachable drawer track as claimed in claim 1, wherein said rail includes a lug formed near the center thereof and projecting toward said track.

5. The retaining device for a detachable drawer track as claimed in claim 4, wherein said pull bar contains a central opening to receive said lug to prevent said pull bar from being pulled over the lug.

* * * * *